United States Patent [19]

Bullington et al.

[11] 4,314,543

[45] Feb. 9, 1982

[54] STOVE SAFETY GUARD

[76] Inventors: John G. Bullington, Rte. 1, Old Madison Rd., Madison Heights, Va. 24572; Lemmie D. Tate, Rte. 2, Box 274, Amherst, Va. 24521

[21] Appl. No.: 165,803

[22] Filed: Jul. 3, 1980

[51] Int. Cl.[3] ..... F24C 15/36

[52] U.S. Cl. ..... 126/201; 126/202; 237/79

[58] Field of Search ..... 126/214 D, 201, 202, 126/298, 278, 203; 237/79

[56] References Cited

U.S. PATENT DOCUMENTS

| | | | |
|---|---|---|---|
| 610,555 | 9/1898 | McNamee | 126/202 |
| 806,160 | 12/1905 | Metz | 126/202 |
| 1,734,568 | 11/1929 | Elters | 237/79 |

FOREIGN PATENT DOCUMENTS

| | | | |
|---|---|---|---|
| 9440 | of 1888 | United Kingdom | 126/201 |

*Primary Examiner*—James C. Yeung

*Attorney, Agent, or Firm*—Fidelman, Wolffe & Waldron

[57] ABSTRACT

A safety guard for free-standing stoves characterized by an array of bowed, open, hollow tubes secured in a tubular array by horizontal support bars. The array is attachable to the stove. A hinged front section allows for access to the stove.

2 Claims, 9 Drawing Figures

40
100
7
8
9
13
15
16
17
18
11
12
20
22
25
30
42
44
46
48
50
10

STOVE SAFETY GUARD

INTRODUCTION

This invention relates to safety guards for free-standing stoves.

The high cost of heating fuels has spurred a resurgence in solid fuel free-standing, space-heating units, notably in the use of wood stoves for home heating.

Along with this resurgence has come concern over the likelihood that infants and toddlers, in particular, will burn themselves by climbing upon the hot stove, or by grasping the hot stove.

The present invention is directed to prevention of such likelihood through provision of a safety guard structure adapted to keep members of a household, particularly the children, off a hot free-standing stove.

BRIEF DESCRIPTION OF THE INVENTION

The safety guard of the present invention is a fence structure which comprises an array of vertically extending bowed open tubes adapted to surround a stove, spaced apart therefrom. The array of tubes are locked together, top and bottom, by horizontal bars or stanchions mounted on the inside of the tubular array. The tubular array as a whole clamps to the stove by an adjustable bracket that forms part of the safety guard. A section of the safety guard containing the tubes located at the front of the stove is pivotally mounted so that access to the stove may be had by pivoting this front section clear of the stove front. At the rear of the stove the tubular array may have a section of short tubes to fit beneath the stove pipe that typically extends from a backface of free-standing stoves.

The bowed shape of the tubes is important since their curvature prevents small children from using the lower horizontal stanchion for a foothold and the upper horizontal stanchion for a handhold to climb upon the safety guard. In addition, the bow curvature of each tube spaces that portion of the tubular array most likely to be grasped by small children a safe distance from the stove, e.g., a foot or so.

The tubes are hollow, open top and bottom. In consequence when heat radiated from the stove warms up the tubes in the surrounding safety guard, a chimney effect is created inside each tube which draws air into the bottom of each tube, up through the tube, out the top. As a result, the tubes do not heat to the point of being dangerous to the touch.

DISCUSSION OF THE INVENTION

For further understanding of this invention, reference is made to the attached drawing wherein.

Figure 1:
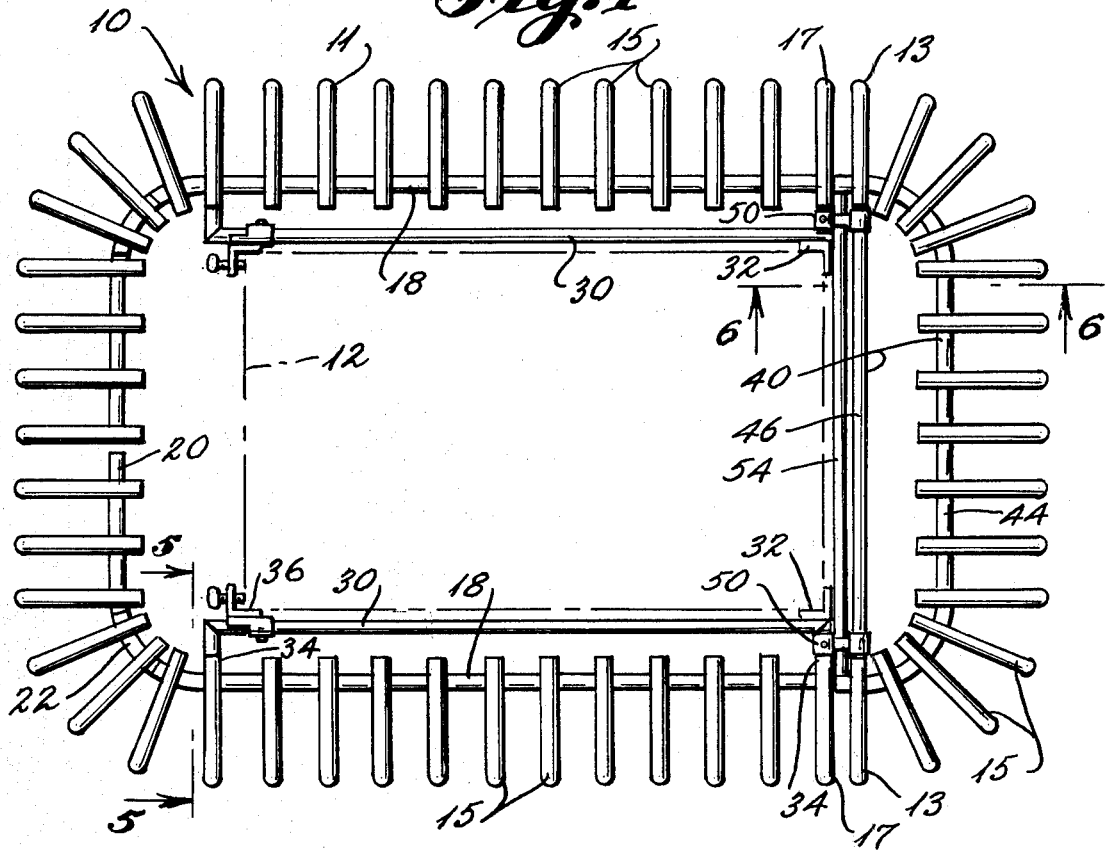
FIG. 1 is a top plan view of the safety guard.

As can be seen in the drawing, and in particular in FIG. 1, the safety guard 10 comprises an array 11 of tubes that surround a free-standing stove 12 like a picket fence.

Figure 3:
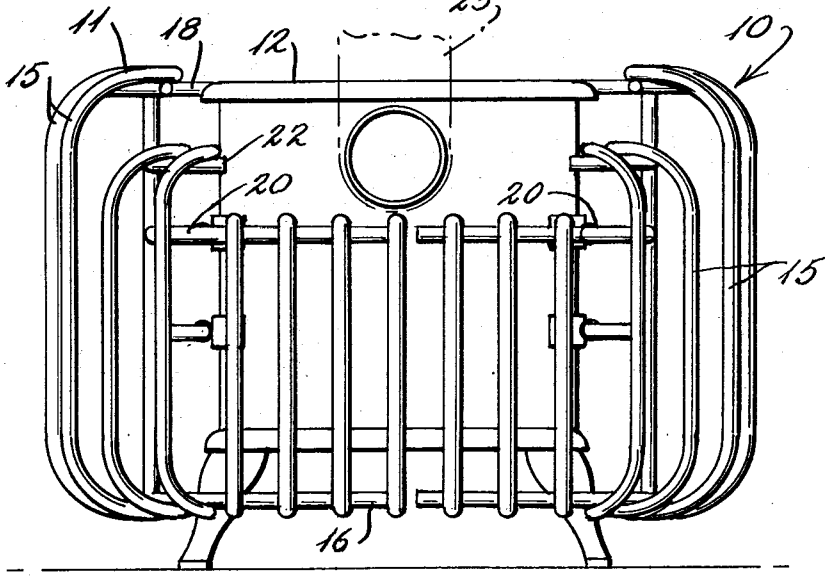
FIG. 3 is a rear elevation.
Figure 2:
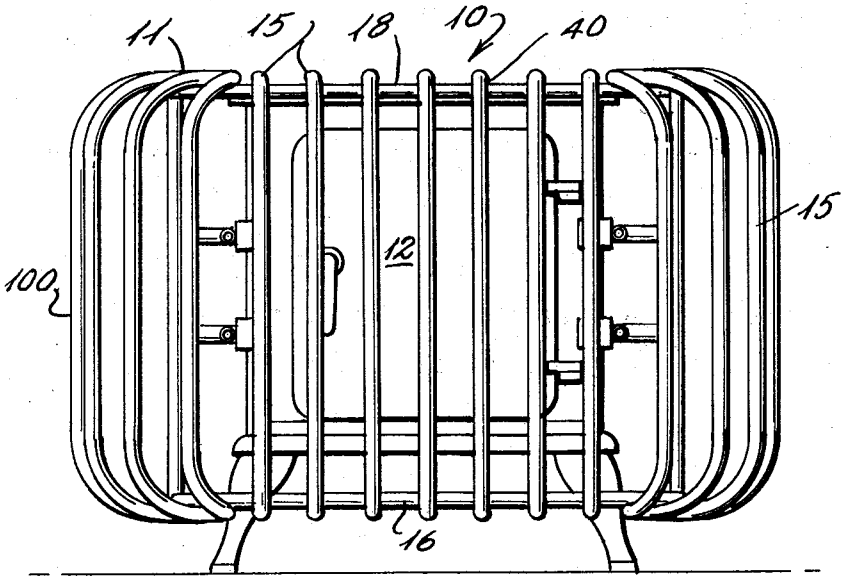
FIG. 2 is a front elevation.
Figures 4, 8, 9:
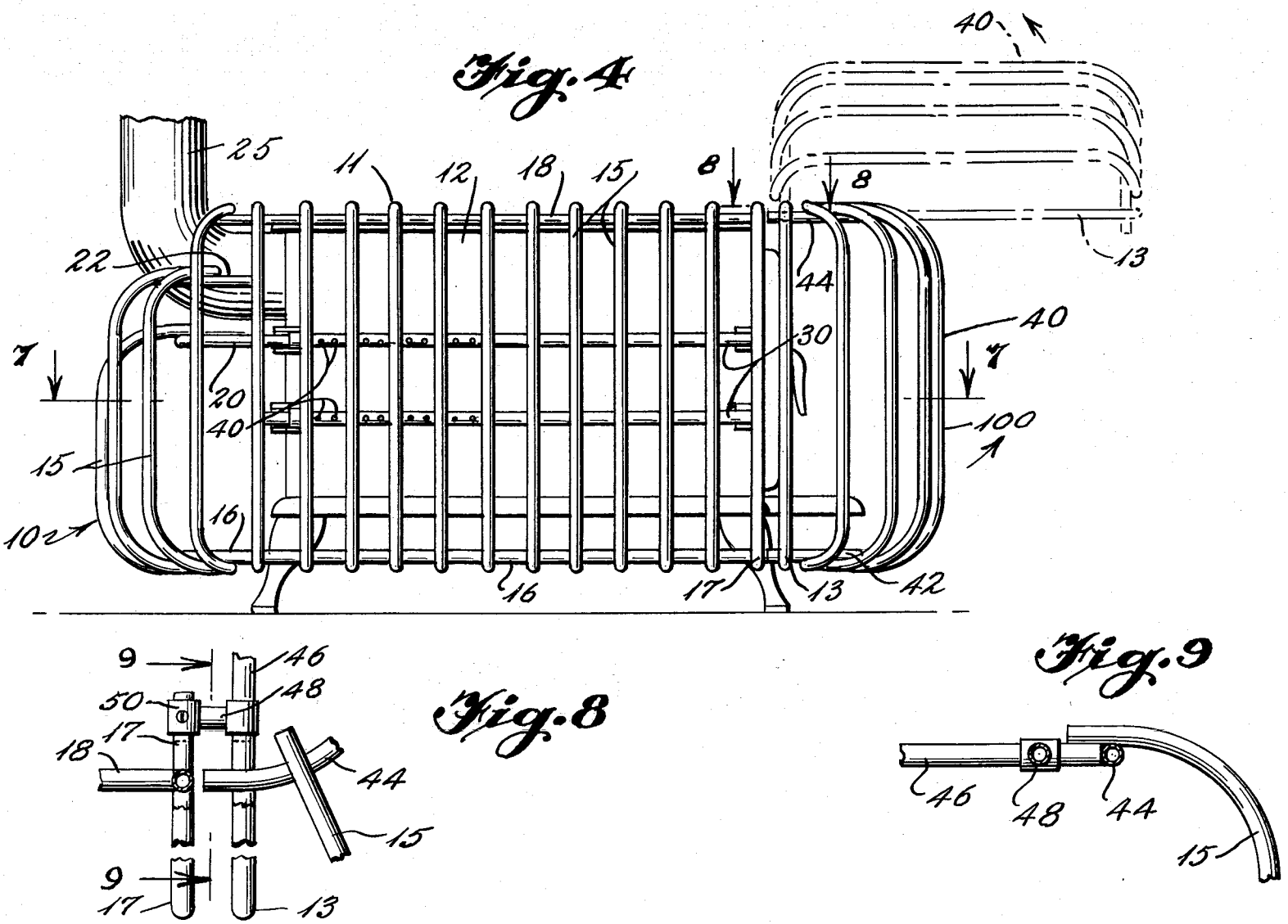
FIG. 4 is a side view, showing in shadow the front face of the safety guard in raised position.
FIG. 8 is a partial section taken along lines 8—8 of FIG. 4.
FIG. 9 is a partial section taken along lines 9—9 of FIG. 8.

The individual tubes 15 in the array are secured to a set of horizontal support bars or stanchions inside array 11 as for example by welding. Horizontal support bar 16 at the bottom of the tubes at the sides and rear of stove 12; horizontal support bar 18 at the top of the tubes on the sides of the stove; a pair of upper horizontal support bars 20 and 22 at the rear of stove 12 where shorter tubes are provided so that the safety guard 10 may fit around the stove pipe 25 that extends from the rear of stove 12 lock tubes 15 into tubular array 11. FIGS. 3 and 4 illustrate the tube and support bar arrangement at the rear of stove 12.

Figure 5:
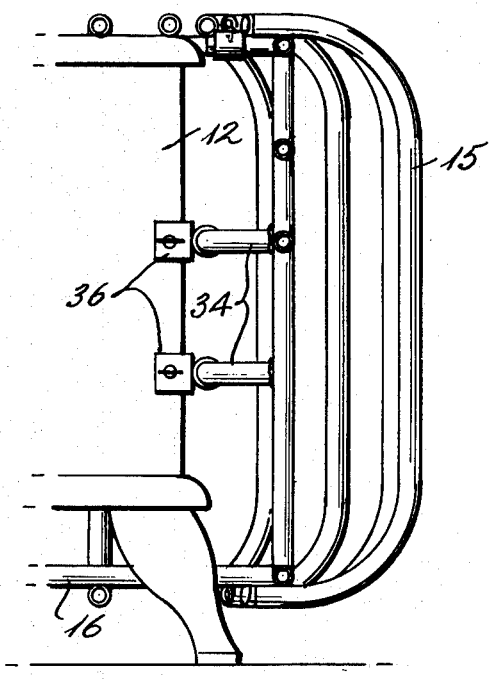
FIG. 5 is a partial section taken along lines 5—5 of FIG. 1.
Figure 6:
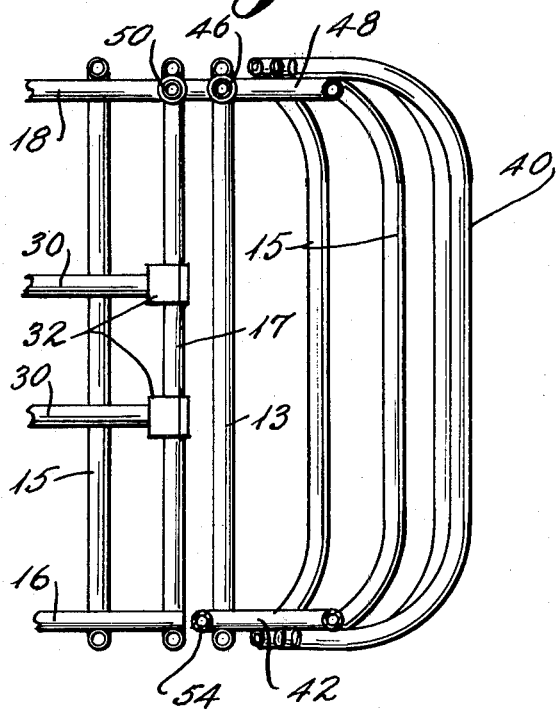
FIG. 6 is a partial section taken along lines 6—6 of FIG. 1.
Figure 7:
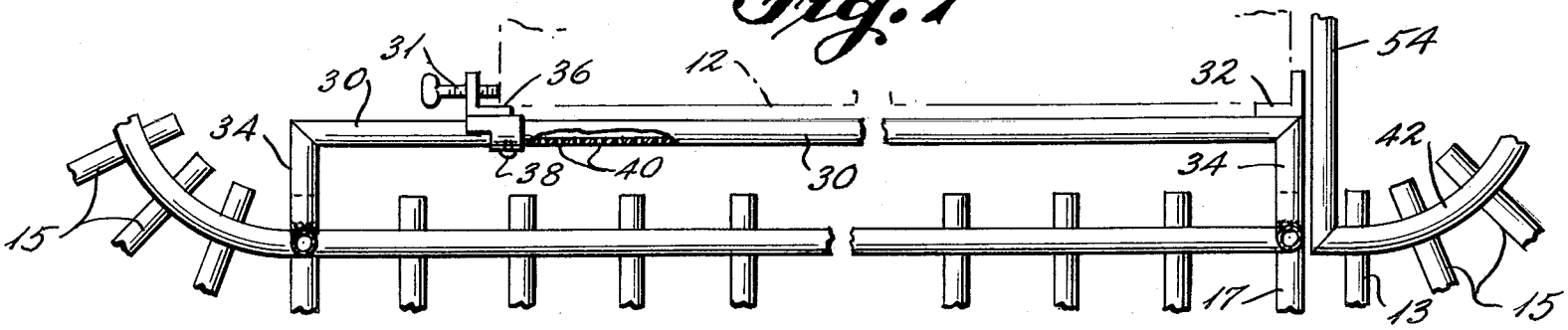
FIG. 7 is a partial section taken along lines 7—7 of FIG. 4.

Also, inside of tube array 11 is a set of bracket structures 31 that clamp to stove 12 so as to hand safety guard 10 on the stove, with the bottoms of tubes 15 just clearing the floor. The bracket structure comprises a bar 30 that extends longitudinally front to rear of stove 12 adjacent the stove. On the front end of bar 30 is an angle 32 adapted to seat against a front of stove 12, as is shown on FIGS. 1 and 6. At the rear end of bracket bar 30 is an adjustable clamp 36 adapted to seat against a rear corner of stove 12 as is shown in FIGS. 1 and 5. A pin or a set screw 38 which fits into any one of the series of apertures 40 (see FIG. 7) on bracket bar 30 allows adjustable clamp 36 to be positioned almost anywhere along the length of the bar 30, creating considerable flexibility for the bracket structure as a whole and allowing for attachment of safety guard 10 to stoves of different lengths. Lateral legs 34 at the ends of bar 30 are welded appropriately to two of the tubes 15.

If desired, the location of bracket structures 31 may be made adjustable vertically by placement of vertically spaced apart apertures in the tubes on which the legs 34 of bracket bar 30 seat, and a pin or set screw on each leg 34.

Safety guard 10 is provided with four brackets 31 set as an upper and lower pair of brackets on each side (see FIG. 1 and 4).

Since brackets 31 clamp on to stove 12, it should be apparent that the brackets as a group can clamp higher up or lower down on stove 12 than is illustrated. This allows the user to predetermine the clearance between safety guard 10 and the floor according to household needs, e.g., very close to the floor in a household containing infants, higher up in a household containing elderly persons.

At the front face of stove 12, safety guard 10 has a hinged section 40 thereon. Hinged section 40 comprises the front face tubes mounted on lower horizontal support bar or stanchion 42 and an upper horizontal support bar on stanchion 44, a cross arm or bar 46 extends across the front face of stove 12 and conveniently is secured to the end bars of tubes 13 on hinged section 40.

The details of the hinge structure is illustrated on FIGS. 8 and 9. There it may be seen that rotatable hinge joint 50 is mounted on a hinge arm 17 that extends from the last tube 17 of the stationary set of tubes in array 11, the same tubes 17 that carry the front end legs 34 of brackets 31. Link 48 connects hinge joint 50 to cross arm or bar 46. A lower horizontal cross arm or bar 54 connected across the ends of the lower horizontal support bar near the bottom of the tube array acts as a stop member when section 40 is down. Thus, in the usual completely fenced in down position for safety guard 10, hinged section 40 will be down as is illustrated in the drawing. However, when access to the stove is required, e.g., to add fuel, hinged section 40 can be pivoted up beyond the position illustrated in shadow on FIG. 4 to completely clear the front face of stove 12.

While the horizontal hinge arrangement herein illustrated and described above is preferred, it may be appreciated that a like vertical hinge arrangement can be provided so that hinged section 40 opens to one side (e.g., like a door) and such is contemplated within practice of this invention.

A significant characteristic of the safety guard of this invention is that the structure is quite difficult for a small child to penetrate. As can be seen in FIG. 4, safety guard 10 has been mounted on stove 12 so that the tube array 11 extends very close to the floor, e.g., 4"; too close for an infant to crawl under. The individual tubes 15 are spaced too close together, e.g., 3", for a child to pass between tubes. In addition, climbing up over safety guard 10 has been made difficult. As can be seen best in FIGS. 1 and 4, the individual tubes 15 are sharply bowed. Even if a toddler were able to reach one of the lower horizontal support bars 16 and/or an upper horizontal support bar 18, their location well inside the vertical run portion 100 of the tubes 15 will prevent the toddler from using the stanchion as footrest or handhold for climbing up the safety guard.

The structure of safety guard 10 incorporates several safety features therein. Thus, it may be observed that even though the guard as a whole which surrounds the stove 12 is close enough to the stove to be attached thereto by the brackets 31, the vertical run portion 100 of bowed tubes 15 is spaced relatively far away from the stove, e.g., about a foot, keeping curious infants and toddlers at a safe distance from stove 12. However, the tubes are close enough to the stove, to become heated up by radiant heat when the stove is fired up. Use of open hollow tubes as is herein contemplated offers a special advantage. Each tube acts as a convection circulator. Relatively cool air is drawn in at the open bottom of each tube, then is heated by the tube wall and flows out the open top of each tube much warmed. This chimney effect maintains tubes 15 somewhat cooler than they would otherwise be.

Although the above discussion of the safety features built into the stove guard structure has emphasized protection of toddlers and infants, other members of the household may benefit. Presence of the safety guard around a stove prevents placement of furniture, toys, firewood and the like dangerously close to the stove. Also, persons of any age, particularly the elderly are prevented from backing up against a hot stove or stumbling into a hot stove.

The description of the safety guard of this invention hereinabove provided has been posed in terms of a free-standing stove that has been spaced away from any walls. However, wood stoves are sometimes mounted immediately in front of or even partially inside of a fireplace, so that the stove pipe may be extended up into the fireplace flue. In such event, only the front and sides of the stove need be surrounded by the safety guard. Practice of this invention contemplates a safety guard as herein described, omitting, however, some or even all those guard tubes 15 disposed at the rear of stove 12, as may be necessary to fit stove and safety guard to the fireplace opening. In that variation, the rear of stove 12 is shielded by the fireplace, preventing access thereto, leaving the stove effectively surrounded by the safety guard.

In the claims:

1. A safety guard for a free-standing stove comprising:

a multiplicity of generally vertical bowed hollow tubes open top and bottom disposed in a closed array adapted to surround at least the front and sides of a stove;

upper and lower horizontal support bars adjacent the tube ends, said horizontal bars being spaced substantially inward of the periphery of the safety guard as a whole by the bowed structure of the tubes, said vertical tubes being secured to said horizontal support bars;

a hinged section of the tube array adapted to pivot free of the face of the stove providing thereby access to the face of the stove; and, clamping brackets inside the closed array of tubes and attached to said array securing the safety guard to the stove with the tubes spaced well away from the stove.

2. The safety guard of claim 1 wherein the hinged section pivots upwardly.

* * * * *